US005323801A

United States Patent [19]

Kuo

[11] Patent Number: 5,323,801

[45] Date of Patent: Jun. 28, 1994

[54] TAIL RIB STRUCTURE HAVING AN EFFECT OF ENHANCING WIND-RESISTANT STRENGTH OF AN UMBRELLA

[76] Inventor: Cheng M. L. Kuo, 18, Alley 15, Lane 582, Sea Ta Rd., Hsinchu, Taiwan

[21] Appl. No.: 144,397

[22] Filed: Nov. 2, 1993

[51] Int. Cl.[5] ..... A45B 25/00

[52] U.S. Cl. ..... 135/29; 135/31

[58] Field of Search ..... 135/15.1, 25.3, 25.32, 135/29, 30, 31

[56] References Cited

U.S. PATENT DOCUMENTS

| | | | |
|---|---|---|---|
| 1,145,285 | 7/1915 | Williamson | 135/29 X |
| 3,901,257 | 8/1975 | Schafer | 135/25.3 |
| 4,420,007 | 12/1983 | Wu | 135/25.3 |
| 4,815,489 | 3/1989 | Yang | 135/25.3 |
| 5,235,998 | 8/1993 | Liu | 135/31 X |

FOREIGN PATENT DOCUMENTS

| | | | |
|---|---|---|---|
| 2422209 | 11/1975 | Fed. Rep. of Germany | 135/29 |

*Primary Examiner*—Carl Friedman
*Assistant Examiner*—Lan C. Mai
*Attorney, Agent, or Firm*—Morton J. Rosenberg; David I. Klein

[57] ABSTRACT

A tail rib structure comprises a tail rib with its inner end pivotally connected to the outer end of a flexible rib by way of a pin passing through a round hole on a flat portion formed on the inner end of the tail rib and a husk encasing the joint between the tail rib and the flexible rib. The tail rib structure can provide high wind-resistant strength for an umbrella.

1 Claim, 7 Drawing Sheets

TAIL RIB STRUCTURE HAVING AN EFFECT OF ENHANCING WIND-RESISTANT STRENGTH OF AN UMBRELLA

BACKGROUND OF THE INVENTION

FIG. 1 shows a prior art umbrella, in which a husk (1) encloses the pivotal joint connecting a tail rib (2) to an intermediate rib (3) to form a construction of an umbrella. The husk (1) has a tail end (11) embracively engaged with the front end of the tail rib (2) to enhance the strength of an umbrella and to align the tail rib (2) and the intermediate rib (3) in an approximately straight line when the umbrella opens. However, the outer end (21) of a tail rib (2) is usually connected to an umbrella cloth. When wind is strong, the energy applied on the surface of an umbrella canopy and transmitted to ribs (as shown in FIG. 2) often breaks the husk (1) at its root (111) and the tail rib (2), which disables an umbrella.

In view of the deficiency, the primary object of the invention is to provide a tail rib structure that elongates the pivotal joint between the tail rib and the flexible rib and which encases the joint in a husk to construct an umbrella having high wind resistant strength.

Now, the structure and features of the invention are described below in detail with reference to the accompanying drawings.

DETAILED DESCRIPTION

Figure 1:
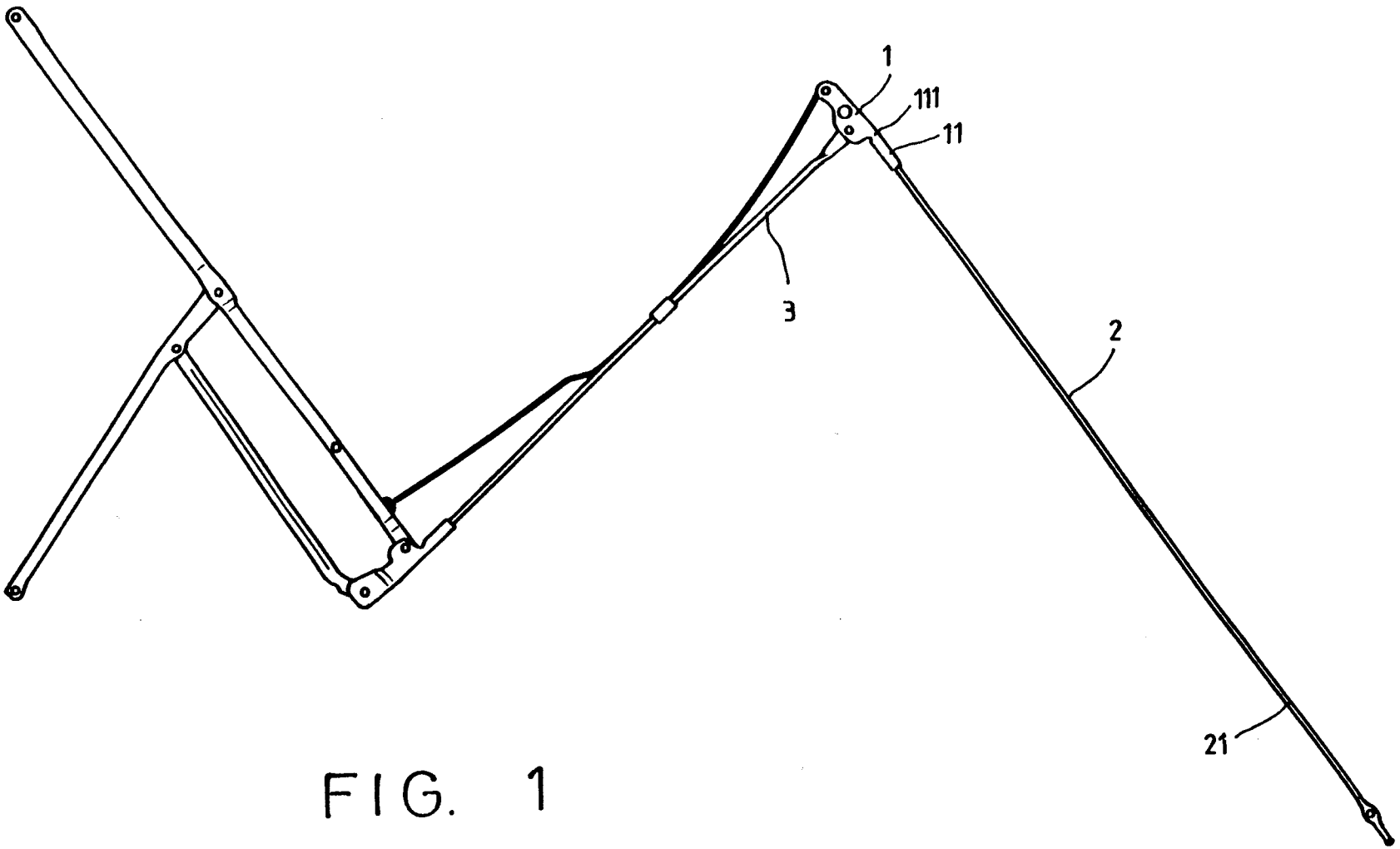
FIG. 1 is a schematic view showing a prior art rib structure.
Figure 2:
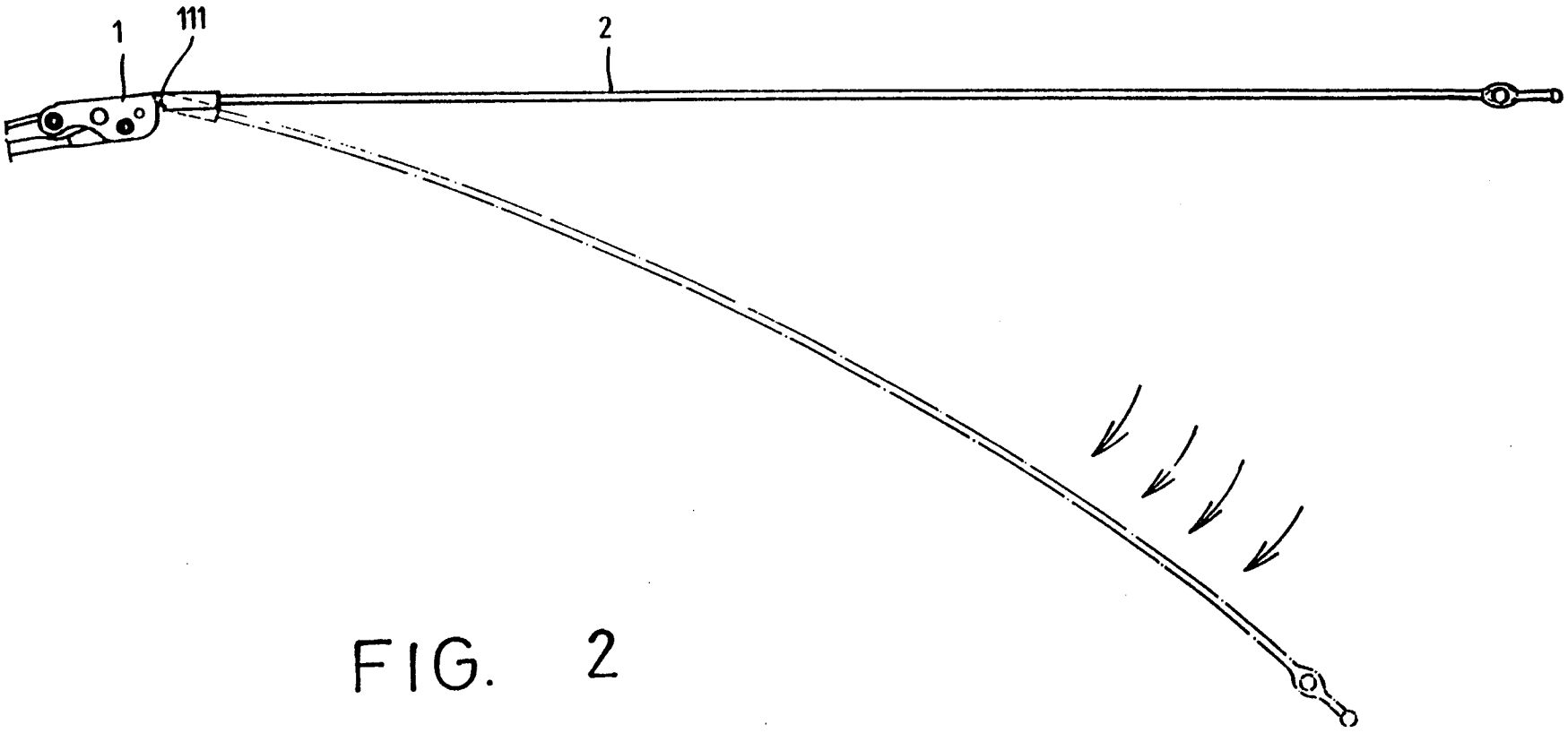
FIG. 2 illustrates the deflection of a prior art tail rib when the tail rib withstands a strong wind.
Figure 3:
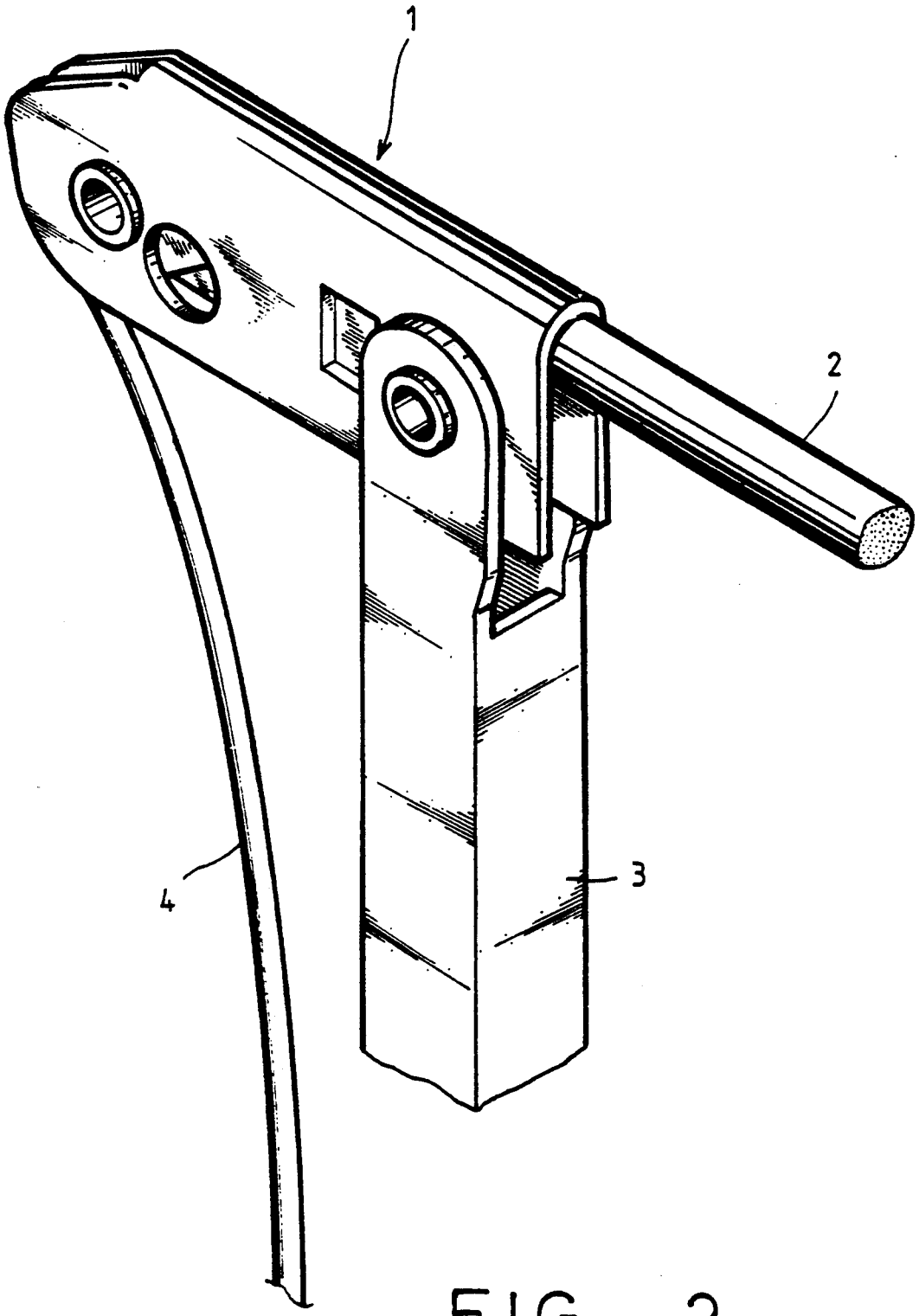
FIG. 3 is a perspective view of the embodiment of a tail rib structure according to the invention.
Figure 4:
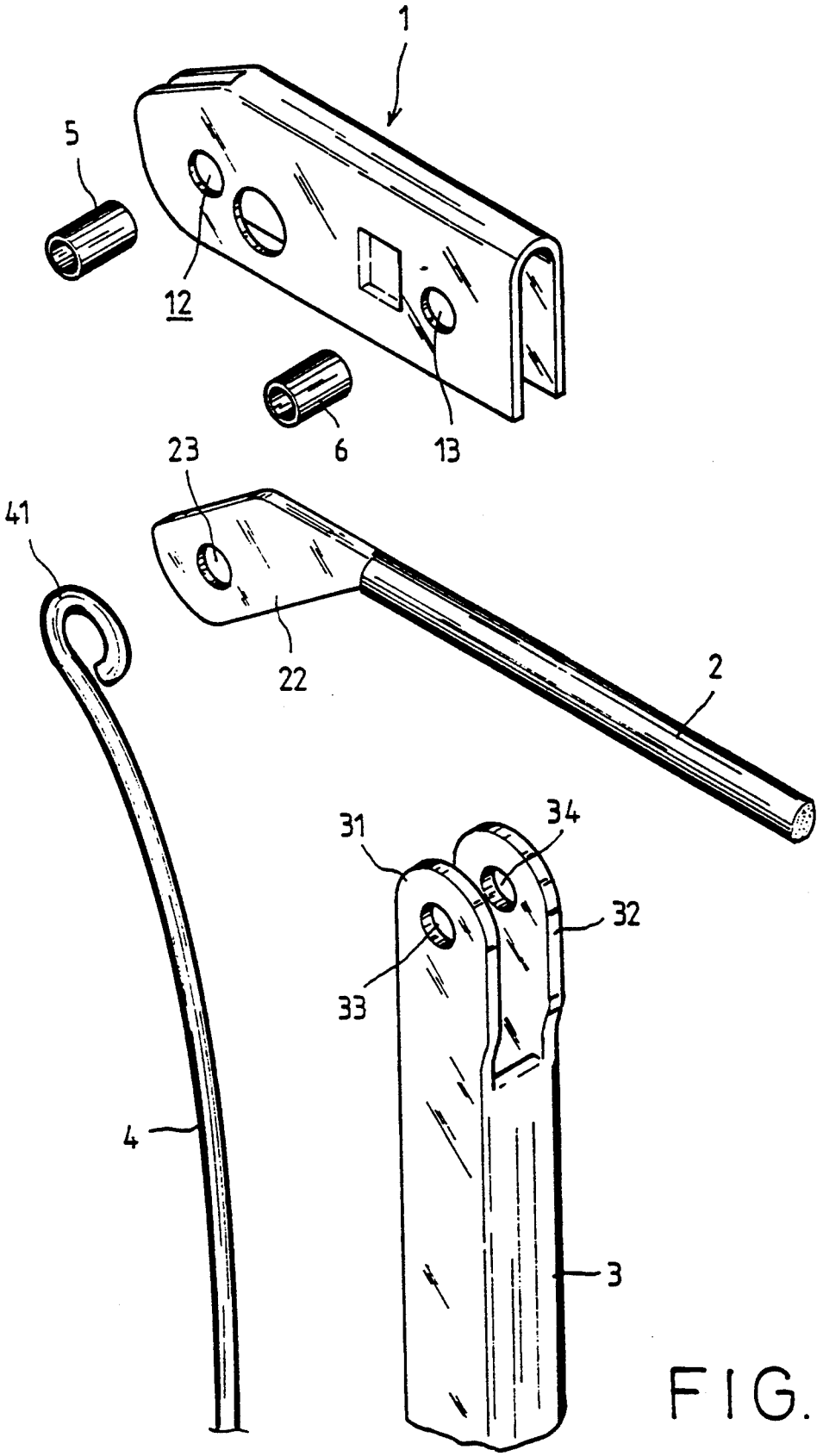
FIG. 4 shows the individual parts of the tail rib structure of the invention.
Figure 5:
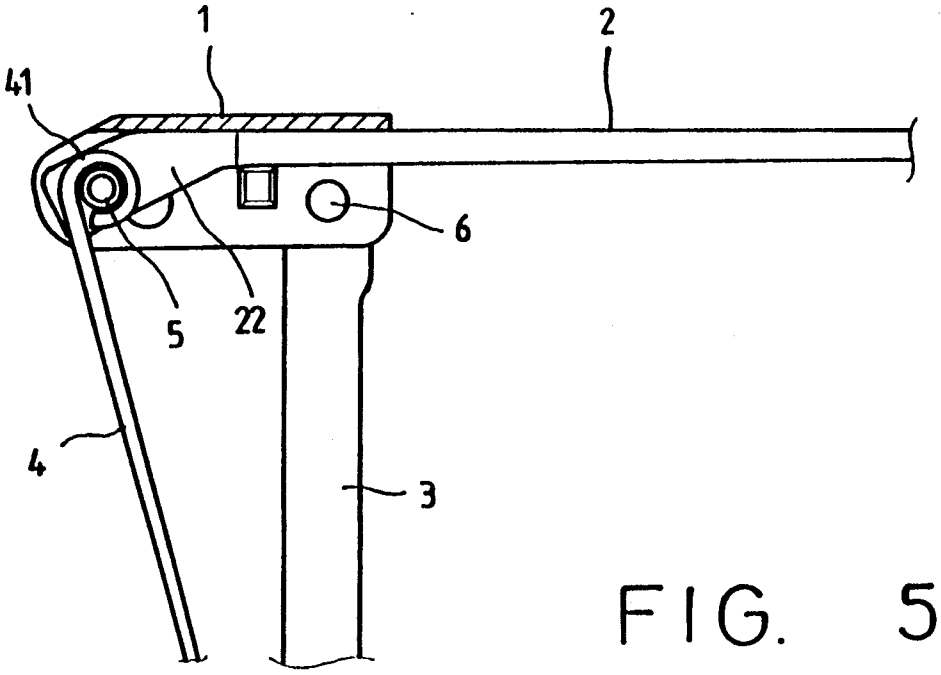
FIG. 5 is a cross sectional view of the tail rib structure of the invention.

Referring to FIGS. 3 through 5, the tail rib structure of the invention is useful in a multiple fold umbrella. To make the explanation clearer, the illustration focuses on a portion of an umbrella comprising a husk (1), a tail rib (2), an intermediate rib (3), and a flexible rib (4). In the structure, a husk (1) is provided with two sets of pivotal holes (12) and (13) to receive two pins (5) and (6) one of which passes through a hole (41) on the outer end of a flexible rib (4) as well as a hole (23) on the flat portion (22) of a tail rib (2), with two ends of the pin (5) mounting on the husk (1) at the pivotal holes (12) to pivot the flexible rib (4), the husk (1), and the tail rib (2) at a common point, and the other of which passes through holes (33) and (34) separately formed on two lugs (31) and (32) on the outer end of an intermediate rib (3) and is rotatably supported on the husk (1) at pivotal holes (13) thereof. The space between two lugs (31) and (32) provides room for the tail rib (2) to rotate freely.

Figure 6:
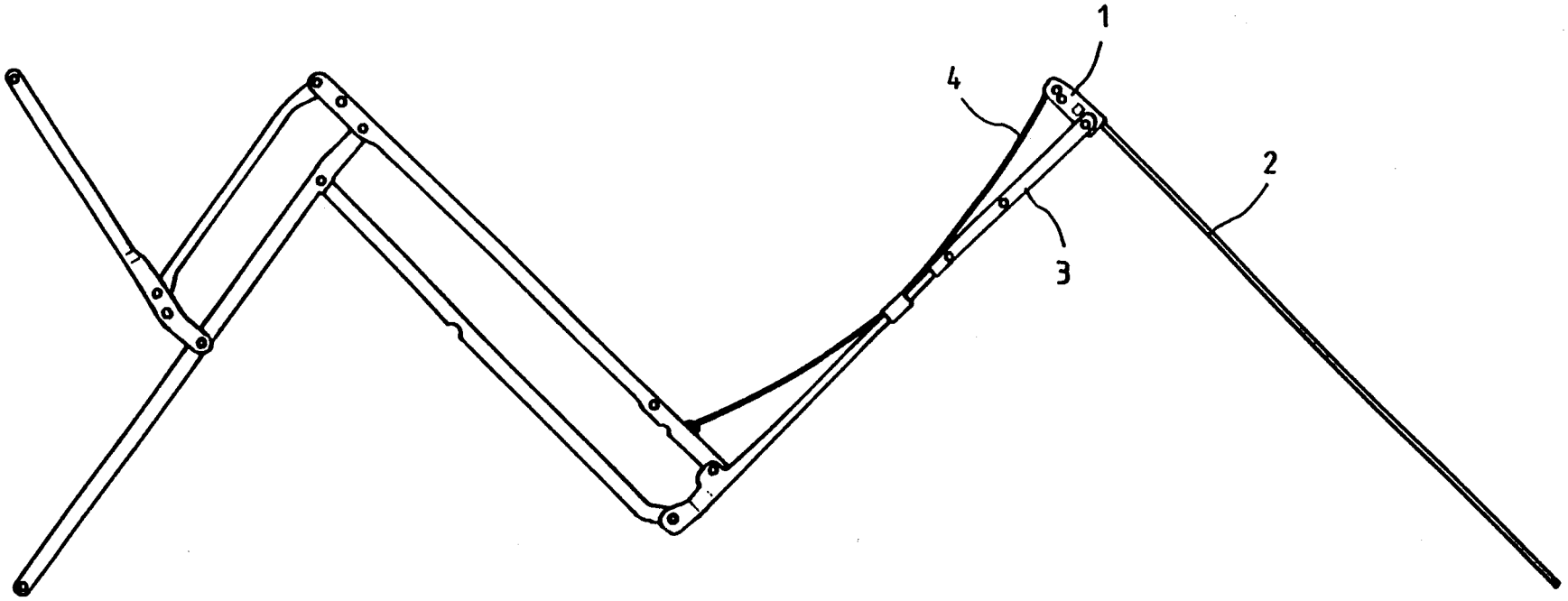
FIG. 6 indicates the use of a tail rib structure of the invention in an umbrella.
Figure 7:
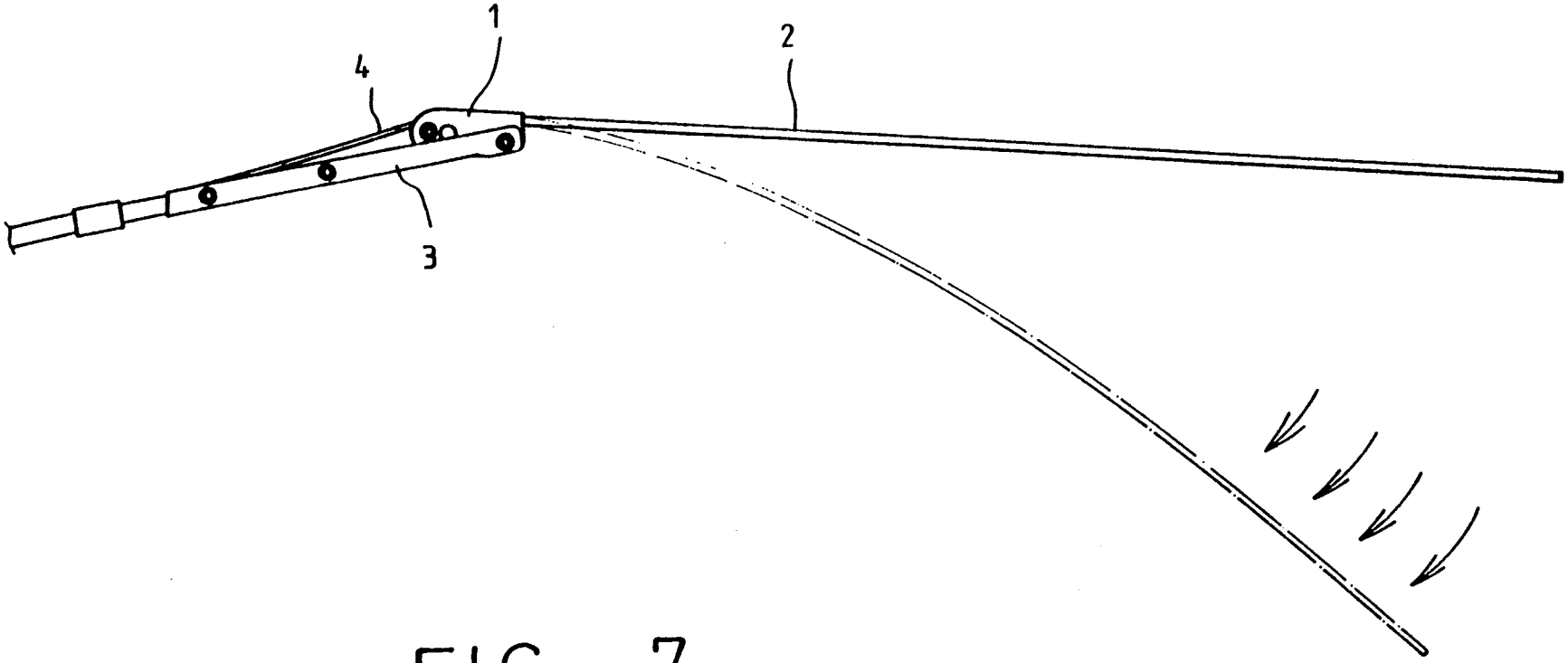
FIG. 7 illustrates the deflection of the tail rib structure of the invention under a strong wind.

From the described above, the tail rib (2) of the invention is pivotably connected to a husk (1) and a flexible rib (4) at the inner end of the tail rib (2). Therefore, the wind force applied to an umbrella, as shown in FIGS. 5 and 6, will not concentrate on the husk (1) but distribute on both the husk (1) and the whole inner end portion of the tail rib (2). In addition, the buffering effect of a flexible rib (4) further heightens the strength of a whole umbrella, ensuring the umbrella against damage and destruction from strong winds.

What is claimed is:

1. A wind resistant umbrella structure comprising:

(a) an elongated tail rib member forming a flattened end section having a tail rib opening formed therethrough;

(b) an elongated husk member having an inverted U-shaped cross-sectional contour defining a pair of husk leg members, said husk member having a first pair and a second pair of aligned husk openings passing through said husk leg members;

(c) an elongated flexible rib member having an end section forming an eyelet, said flexible rib member and said tail rib member flattened end section being insertable between said legs of said husk member for alignment of said first pair of husk openings, said tail rib opening and said flexible rib member eyelet, said tail rib member, said husk member, and said flexible tail rib member being rotatably coupled each to the other by a first pin member passing through said aligned first pair of husk openings, said tail rib opening and said eyelet; and (d) an elongated intermediate rib member having a pair of displaced end section lug members having aligned lug openings formed therethrough, said husk member leg members being insertable between said lug members for alignment of said lug openings with said second pair of husk openings, said intermediate rib member and said husk member being rotatably coupled each to the other by a second pin member passing therethrough.

* * * * *